US006802797B2

(12) United States Patent
Maresh

(10) Patent No.: US 6,802,797 B2
(45) **Date of Patent: *Oct. 12, 2004**

(54) FOUR BAR EXERCISE MACHINE

(76) Inventor: Joseph D. Maresh, P.O. Box 645, West Linn, OR (US) 97068-0645

( * ) Notice: Subject to any disclaimer, the term of this patent is extended or adjusted under 35 U.S.C. 154(b) by 235 days.

This patent is subject to a terminal disclaimer.

(21) Appl. No.: 09/938,246

(22) Filed: Aug. 23, 2001

(65) Prior Publication Data

US 2003/0040404 A1 Feb. 27, 2003

Related U.S. Application Data

(63) Continuation of application No. 09/300,545, filed on Apr. 27, 1999, now Pat. No. 6,387,017, which is a continuation of application No. 08/914,206, filed on Aug. 19, 1997, now Pat. No. 5,897,463, which is a continuation of application No. 08/497,377, filed on Jun. 30, 1995, now Pat. No. 5,707,321.

(51) Int. Cl.[7] ..... A63B 69/16; A63B 22/04

(52) U.S. Cl. ..... 482/57; 482/52

(58) Field of Search ..... 482/51–53, 57, 482/70, 79, 80

(56) References Cited

U.S. PATENT DOCUMENTS

| | | | | | |
|---|---|---|---|---|---|
| 5,573,480 | A | * | 11/1996 | Rodgers, Jr. | 482/57 |
| 5,591,107 | A | * | 1/1997 | Rodgers, Jr. | 482/57 |
| 5,683,333 | A | * | 11/1997 | Rodgers, Jr. | 482/57 |
| 5,707,321 | A | * | 1/1998 | Maresh | 482/57 |
| 5,897,463 | A | * | 4/1999 | Maresh | 482/70 |
| 6,387,017 | B1 | * | 5/2002 | Maresh | 482/57 |

* cited by examiner

*Primary Examiner*—Stephen R. Crow

(57) ABSTRACT

An exercise apparatus includes a frame designed to rest upon a floor surface, at least one crank rotatably mounted on the frame, and a discrete connector link having a first portion rotatably connected to each crank. A second portion of each connector link is constrained to move in reciprocal fashion relative to the frame, and a third portion of each connector link supports a foot platform. As a result, each foot platform is constrained to move through a generally elliptical path in response to rotation of each associated crank.

9 Claims, 12 Drawing Sheets

FIG. 3
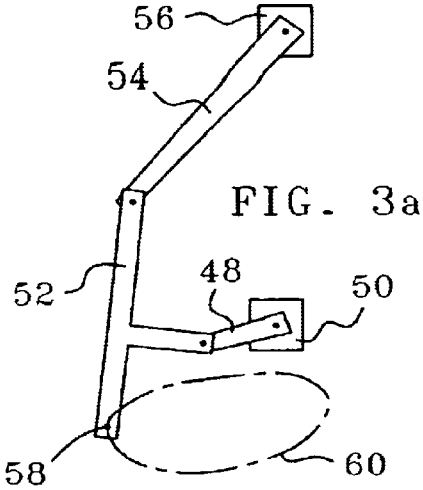
FIG. 3a
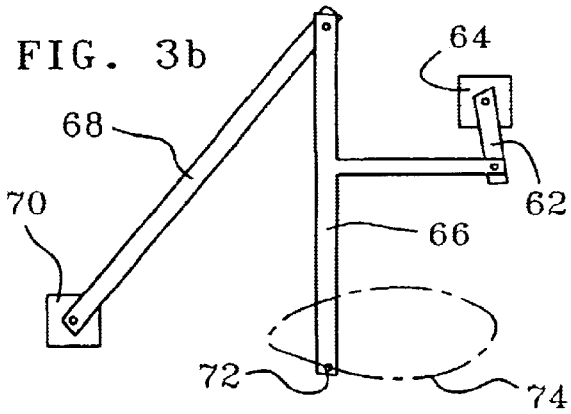
FIG. 3b
FIG. 3c
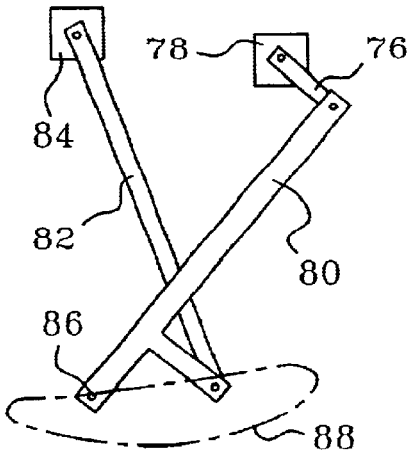
FIG. 3d
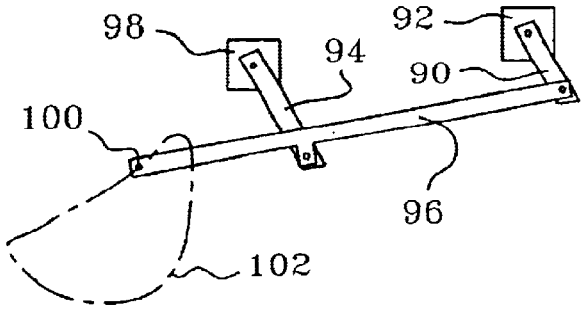
FIG. 3e
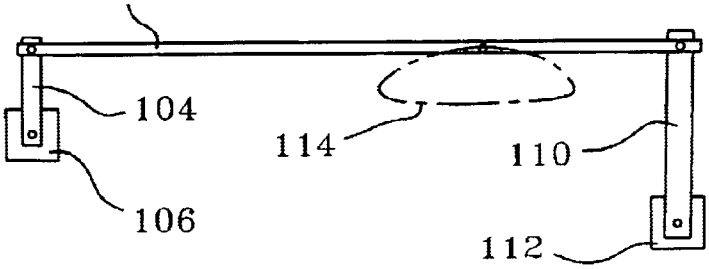

FOUR BAR EXERCISE MACHINE

This is a continuation of U.S. patent application Ser. No. 09/300,545, filed on Apr. 27, 1999 (U.S. Pat. No. 6,387,017), which is a continuation of U.S. patent application Ser. No. 08/914,206, filed on Aug. 19, 1997 (U.S. Pat. No. 5,897,463), which is a continuation of U.S. patent application Ser. No. 08/497,377, filed on Jun. 30, 1995 (U.S. Pat. No. 5,707,321).

BACKGROUND OF THE INVENTION

The prior art is replete with many categories of exercise machines designed to exercise all major muscle groups of the human body. The most popular machines provide motion similar to activities such as bicycling, skiing, walking or stepping. The popularity of these machines is due to the effective low impact form of exercise enabled, as well convenience and time saving advantages.

In reference to machines such as stationary bicycles and steppers which involve the lower body, and cause the operators feet to move under resistance along constrained arcuate paths, evolving bicycle and stepper machine designs continue to incorporate foot motion paths of arcuate forms which are circular by definition. With bicycle machines, the circular path is caused by the simple relationship of the distance between the foot pedal and the pedal crank shaft. This constancy of motion is artificial to the human body, and is not considered by the inventor to be optimum during exclusive use for long term muscular development and conditioning. Bicycle machines do however offer a continuous motion which is preferable in order to ensure machine usage.

In reference to stepper machines, the arcuate path that the foot platforms travel about is a simple function of the distance between the foot platform and the pivot point of the platform support member. The stop and go motion of conventional steppers, in conjunction with the somewhat linear foot path, is considered by the inventor to be less ergonomic than the four bar stepper design of the present invention.

If one studies the motion paths of human feet during an activity such as walking or running, it will readily be observed that they travel along paths more accurately described as teardrop shaped. Whereas in the case of hill or stair climbing, the motion of ones feet closely resembles an ellipse or oval. The present invention provides a means to satisfactorily produce either motion, teardrop or elliptical, and does so in an efficient and economical way.

BRIEF DESCRIPTION OF THE INVENTION

The present invention provides a means to generate a number of characteristically distinct closed curves by using an arrangement of linkages. In all of the embodiments of this invention, the motion output of the linkages occurs at the foot pedals or foot platforms. Output of the linkages is also illustrated in several figures to additionally interface with a persons arms or hands in order to exercise upper body muscles.

Generally, the dynamic linkage portion of the mechanism may be described as containing three pin connected links, and in most of the illustrated embodiments, these link assemblies are interconnected by a common crank shaft. In this text, the general terms for these three dynamic links are crank, connector, and rocker. The frame of the machine serves as a fourth stationary link. The length of each of these four links, in combination with the arrangement in which they are pinned together, establishes the desired output exercise curve.

The first link is the shortest of the four links and is referred to as a crank link. The crank link is not to be considered figuratively as a drive link because this link receives force and is caused to rotate due to actions of the machine operator. It is possible however to drive this crank link independently by a motor or such if the design of a powered exercise machine is desired.

In the embodiments which provide a common crank shaft between a right and a left foot or hand receiving member, the attached cranks are diametrically opposed as to operate out of phase with respect to each other by 180 degrees. This phase difference of 180 degrees is not directly equatable to the relative positions of the foot platforms due to differences of instantaneous velocity or accelerations of the foot platforms at different path points. For the linkage system shown in the first figure, the platforms are positionally maintained out of phase by approximately 180 degrees, and the operator would not sense an imbalance of platform velocity or acceleration.

On those linkage mechanisms which generate pedal path curves where significant imbalance is present, it is not to be considered a disadvantage. When one considers the motion one's feet experience on your average walk or hike on rough ground, the feet experience quite random, unequal, and unsynchronous paths and velocities. The inventor, having traversed uncounted miles of rough forested terrain, can speak with authority as to the physical benefits derived from such variable and random action.

Although the most popular application of this invention would subject both feet along separate elliptical paths on two foot platforms out of phase with respect to each other by 180 degrees, another embodiment, intended primarily for a recumbent style exercise machine provides only one, relatively wide foot platform. In this embodiment the user reclines on a sloped bench and pumps the foot platform throughout an elliptical path with both feet side by side in a continuous, momentum gaining manner. This form of exercise is intended to be similar to squatting and standing exercises while eliminating strain and potential injury to back muscles.

Continuing now, the second link, referred to as a connector link, is rotatably attached to both the crank and the rocker. The foot platforms and/or hand receiving members are also rotatably attached to this connector link such that a total of at least three pin joints are always present and utilized at the connector link. The connector link cyclically translates while rotating a limited amount during machine operation.

The third link, referred as a rocker, is attached to the frame or stationary link at one end, and to the connector link at its opposite end. This rocker link will never completely revolve, but rather swing back and forth a limited amount.

The stationary link or fourth link rotatably secures the crank and the rocker to the machine frame.

In the preferred embodiment, the connector link is rotatably mounted at one distal end to the crank, and at an opposite distal end to a foot platform. Offset and between these opposite distal ends the crank is rotatably secured.

In order to ensure smoothest operation while cycling the foot platforms, particularly while they are at their minimum and maximum defection point, a flywheel may be coupled to the crankshaft.

BRIEF DESCRIPTION OF THE DRAWINGS

The invention will be further described in conjunction with the accompanying drawings, which illustrate preferred embodiments, and wherein:

FIG. 3 (3*a*-3*e*) are side views of four bar linkages which produce characteristically distinct and useful motion paths at the foot platforms.

DETAILED DESCRIPTION OF THE INVENTION

Figure 1:
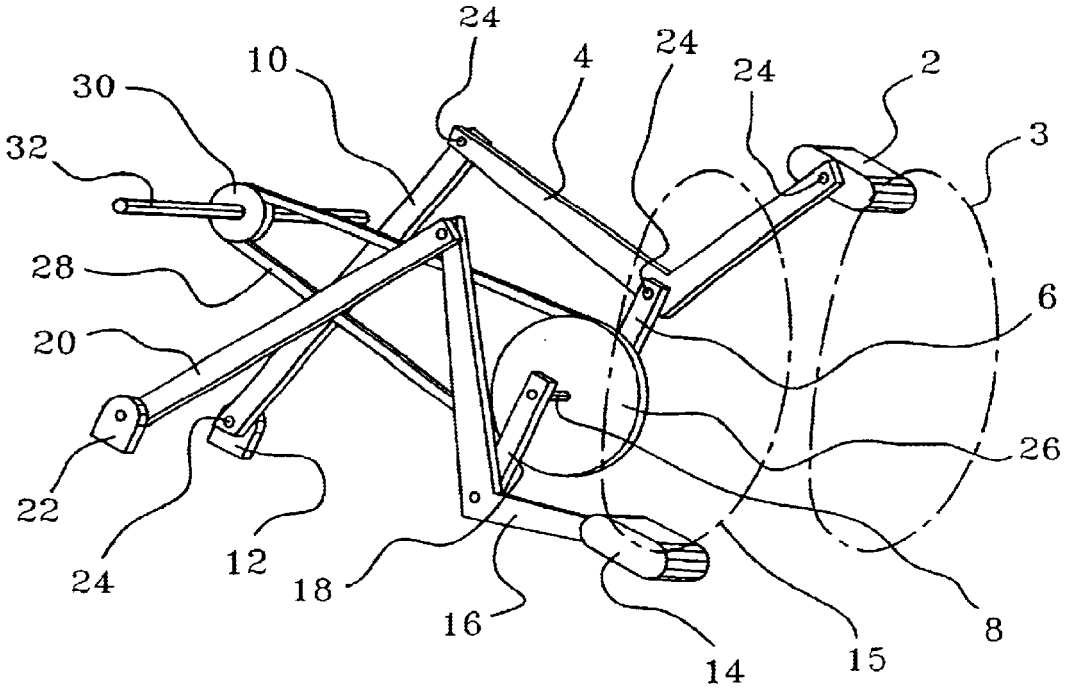
FIG. 1 is a perspective view of the first embodiment which incorporates means to drive a flywheel, and will be pedaled while the operator is seated.

As shown in FIG. 1, the linkage mechanism consists of three dynamic links. The first foot platform 2 is rotatably secured to first connector link 4 at first first foot platform joint 24. The first crank radius 6 rotates with crank axle 8. Crank axle 8 is rotatable secured to the machine frame. The end of first crank radius 6 is rotatably connected to the first connector link 4 as to cause that point of first connector link 4 to travel along a circular path. A first rocker link 10 is rotatably secured at one end to a distal end of first connector link 4, and at the opposite end to a portion of the machine frame 12. First foot platform 2 is illustrated at its uppermost position, and will be caused to travel along first elliptical path 3 as first crank radius 6 rotates one revolution.

At the opposite side of the machine, second crank radius 18 is secured to crank axle 8 at a diametrically opposite orientation of first crank radius 6. Second connector link 16 is rotatable secured to second rocker link 20 and to second foot platform 14. Second rocker link 20 pivots about a pin joint secured to a portion of the stationary machine frame 22. Because the first and second cranks are orientated 180 degrees opposite, the second foot platform 14 illustrated at the lowermost position of second elliptical path 15 will be maintained approximately 180 degrees out of phase with the first foot platform 2 throughout the cyclic action. Crank pulley 26 may be installed to transmit torque to and from pulley 30 and pulley shaft 32 if a flywheel and/or upper body crank arms are to be installed. A V-belt 28 is illustrated between crank pulley 26 and pulley 30, however a suitable sprocket or timing pulley may be used with a roller chain or timing belt respectively.

Figure 2:
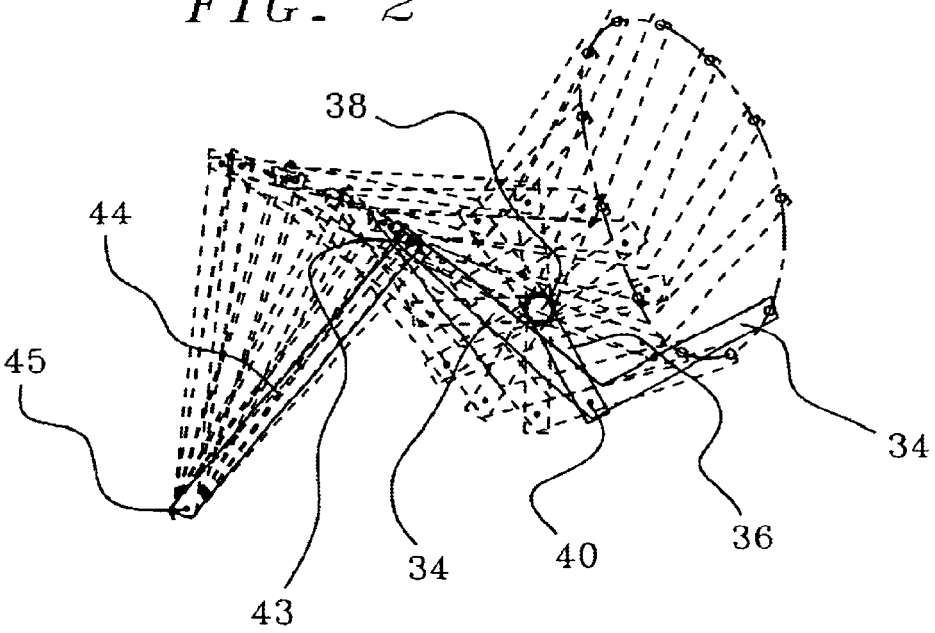
FIG. 2 is a side view of the first embodiment and illustrates the linkages at different positions during the cyclic action.

Referring now to FIG. 2, the three dynamic links are illustrated at multiple positions along the cyclic motion in dashed lines. Crank link 36 rotates once about crank shaft 38 for each complete cycle of the coupled connector link 34 and rocker link 44. Connector link 34 is near the bottom of its cycle, and preferably causes a connected (unillustrated) foot platform to travel along an elliptical path in a counter clockwise direction as the operator faces to the left. In this regard, the linkage mechanism may be operated in either direction unless additional mechanical elements such as one way clutches or bearings are incorporated into the design.

Directing attention now to FIG. 3, five variations of four bar linkages are shown which will cause a foot platform to travel about a closed curve useful when performing exercises. Variations in the shape of the closed curves may be achieved by modifying link lengths and rearranging the points of rotation. By so doing, the curves may approximate near perfect ovals to the aforementioned tear drop shape.

Beginning at FIG. 3*a*, rocker link 54 and crank radius 48 are rotatably secured to the base at 56 and 50 respectively. Both base points are positioned approximately in line and perpendicular to the major axis of the elliptical path 60 formed as the foot platform joint 58 of connector link 52 traverses through its cyclic action.

Referring now to FIG. 3*b*, crank radius 62 revolves about a point fixed to the machine frame or base 64. Rocker link 68 oscillates about a different point of the machine frame or base 70. Coupled between crank radius 62 and rocker link 68 the connector link 66 defines the motion path 74 of the foot platform mounting joint 72. The arrangement and proportions of the dynamic links shown in FIG. 3*b* enables the operator to stand and supplementally rotate the crank radius 62 by hand. A portion of the connector link of FIG. 3*b* is always positioned between the base points.

Referring now to FIG. 3*c*, crank radius 76 is rotatable secured to base 78, and rocker link 82 pivots about base 84. The elliptical path 88 created at foot platform joint 86 during the cyclic motion of connector link 80 is of a relatively high length to width ratio. Base points are located relatively parallel to the major axis of the depicted ellipse.

Directing attention now to FIG. 3*d*, rocker link 94 pivots about base 98 and is rotatably secured to connector link 96. Crank radius 90 revolves about a point fixed on base 92 and causes foot platform joint 100 to define a closed curve 102 resembling the capital letter 'D'. Although FIG. 3*d* is similar to the linkage shown in FIG. 3*c*, minor changes to the crank and the connector in conjunction with substantially shortening and repositioning the rocker results in a characteristically distinct curve.

Referring now to FIG. 3*e*, crank radius 104 revolves about a point fixed to base 106, and causes distal end of connector, link 108 to translate about a circular path. At the opposite distal end of connector link 108 is rotatably secured rocker link 110 as rocker link 110 oscillates about a point fixed to base 112. The elliptical path 114 may be defined at a point directly between the opposite distal ends of connector link 108.

Figure 4:
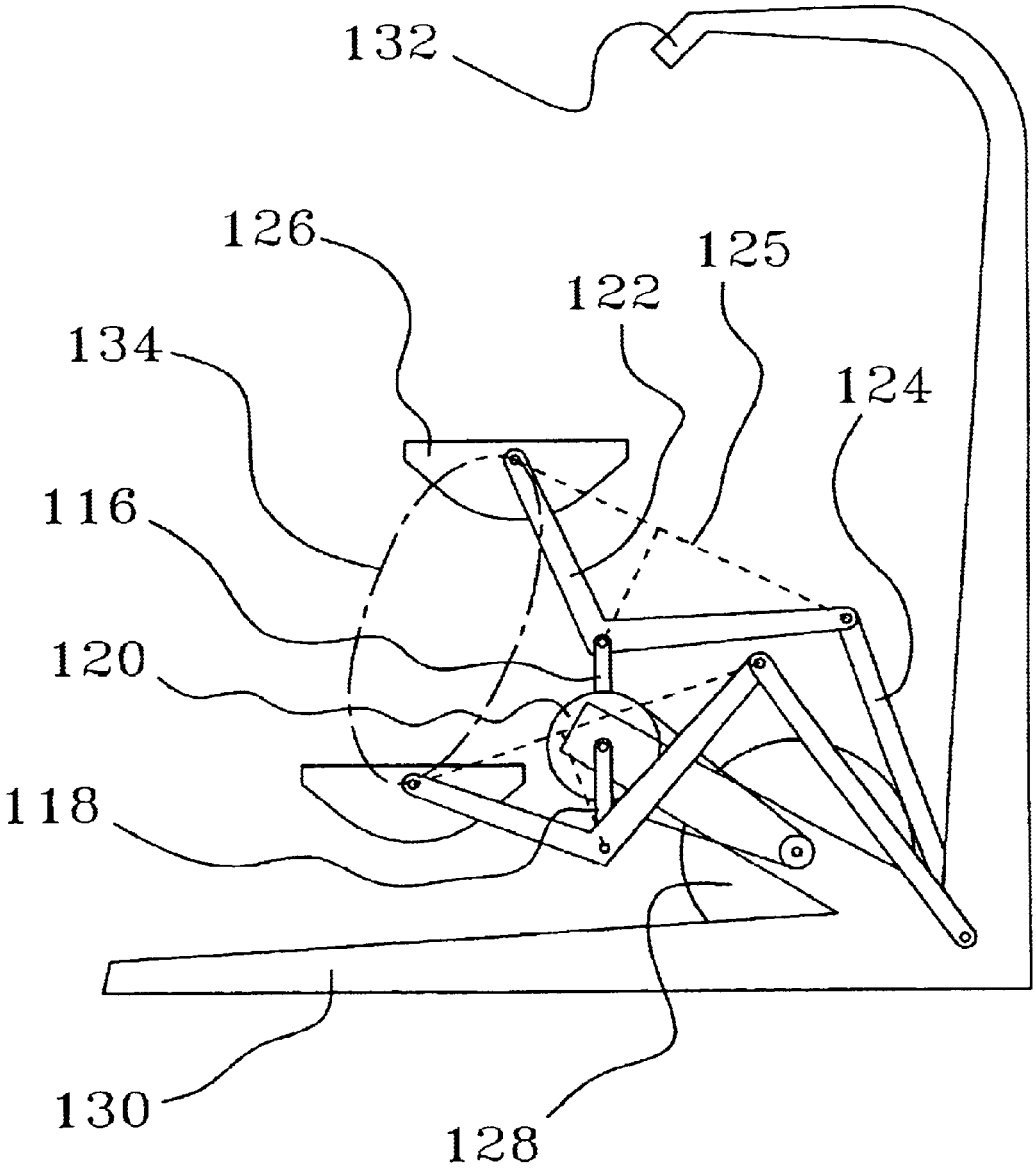
FIG. 4 is a side view of an exercise machine and incorporates pivoting pedals upon the linkage mechanism of the first embodiment.

Directing attention now with FIG. 4, a linkage system characteristic of the first embodiment is shown. The operator will stand with one foot on the first foot platform 126, and with the opposite foot on the second foot platform while treading them about the elliptical path 134. If the foot platforms are to remain level throughout the cyclic action, they must be able to pivot a total range of approximately 38 degrees relative to the connector links, or 19 degrees from a neutral position relative to the connector link. It may be preferable to incorporate rotational stops at the pin joint connecting each of the foot platforms limiting the rotational freedom to a total of 38 degrees in order to facilitate operation.

First crank radius 116 and first rocker link 124 are rotatably secured to the machine frame 130, and also rotatably secured to first connector link 122. Second crank radius 118 is rigidly fixed to and symmetrically opposite first crank radius 116. Handle grips 132 are fixed to the machine frame 130 as a safety aid. Pulley 120 is nonrotatably secured to the first and/or second cranks 116 and 118 respectively and will transmit torque to and from flywheel 128. Additionally, although not illustrated in any of the figures, drag resistance may be incorporated at the machine in any of the embodiments, by installing a band brake upon the flywheel, or hydraulic linear dampers or rotational dampers at any of the dynamic links.

Concluding on FIG. 4, datum lines 125 shown in broken lines illustrates the effective connector link 122 shape, and compares with link mechanism shown in FIG. 3*a*. Note that by establishing a segment line between the connector link foot platform journal (first third connector link joint) to the connector link rocker journal (first second connector link joint), followed by establishing a perpendicular line to the connector link crank journal (first first connector link joint), the perpendicular line will intersect the segment line between the segment line endpoints.

Figure 5:
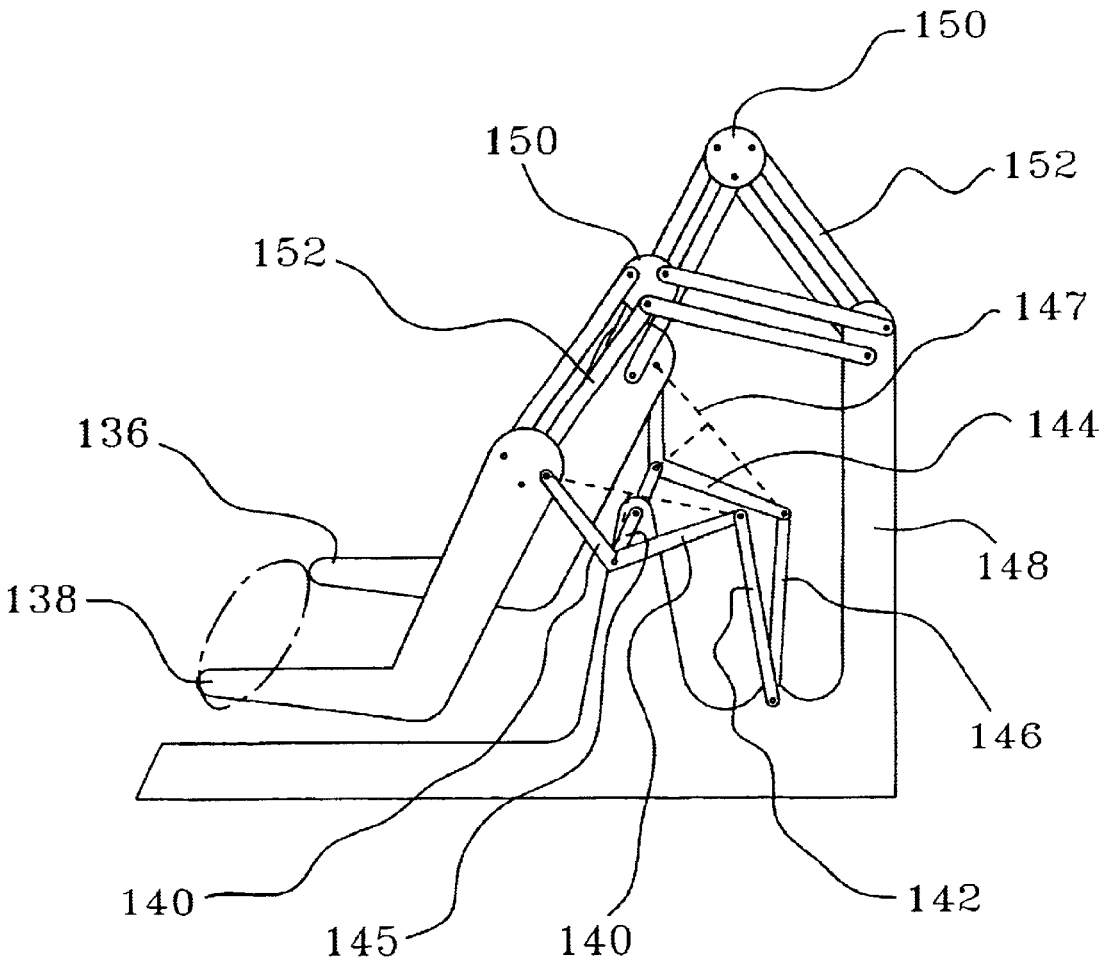
FIG. 5 is a side view of an exercise machine which utilizes a linkage system of the first embodiment, and also utilizes a separate linkage system connected to the foot platforms in order to maintain the platforms parallel and horizontal.

Directing attention now to FIG. 5, the linkage system of the first embodiment is shown with an independent means to maintain the foot platforms 136 and 138 parallel and horizontal. Crank radius 145 is rotatably secured to first and second connector link 144 and 140, and revolves about a fixed point on the machine frame 148. First and second rocker 146 and 142 share a common axis of rotation to the machine frame, and are connected at their opposite ends to first and second connector links 144 and 140 respectively. The platforms are maintained parallel by the geometrical relationships between the pair of identical orientations members 150, the eight identical rigid bars 152, and the constant pin joint hole patterns on the orientation members 150 and at the machine frame 148. The datum lines 147 also compare with FIG. 3*a* of the first embodiment.

Figure 6:
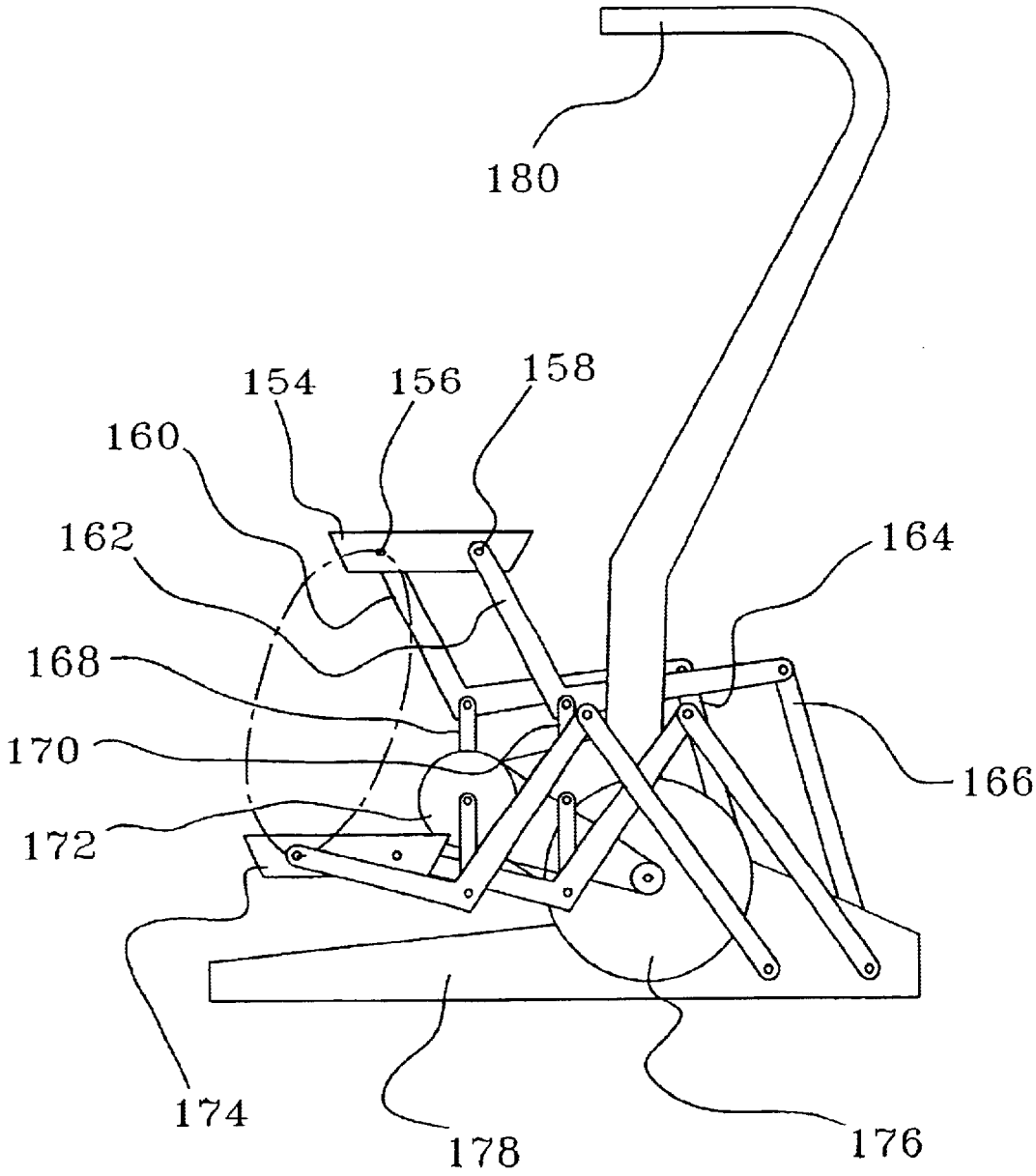
FIG. 6 is a side view of the first embodiment which incorporates a duplicate set of the four bar mechanism in order to maintain the foot platforms parallel and horizontal.

Referring now to FIG. 6, the linkage configuration of the first embodiment is shown in duality in order to provide a means to maintain the first and second foot platform 154 and 174 parallel and horizontal. The first foot platform 154 is rotatably secured at a first first foot platform joint 158 and at a third first foot platform joint 156 to a first connector link 162 and third connector link 160 respectively. Four rocker joints are also shown, with each pair of identically orientated rockers corresponding to one of the two foot platforms. In this embodiment (and also that of FIG. 2), the rockers pivot about a point fixed on the machine frame 178 for a total range of approximately thirty six degrees. The first rocker link 166 and third rocker link 164 have pivoted within eleven degrees of their forward most position while the connected platform is approximately at the apex of its travel. The relative positions between the rotation axes of first crank radius 170 and third crank radius 168 are identical to the relative positions between the axes of rotation of the pin joints present at each of the two foot platforms.

In order to give the machine inertial characteristics, a flywheel drive pulley 172 is fixed to one of the cranks wherein the drive pulley 172 rotational axis is co-axial with the associated crank rotational axis.

Figure 7:
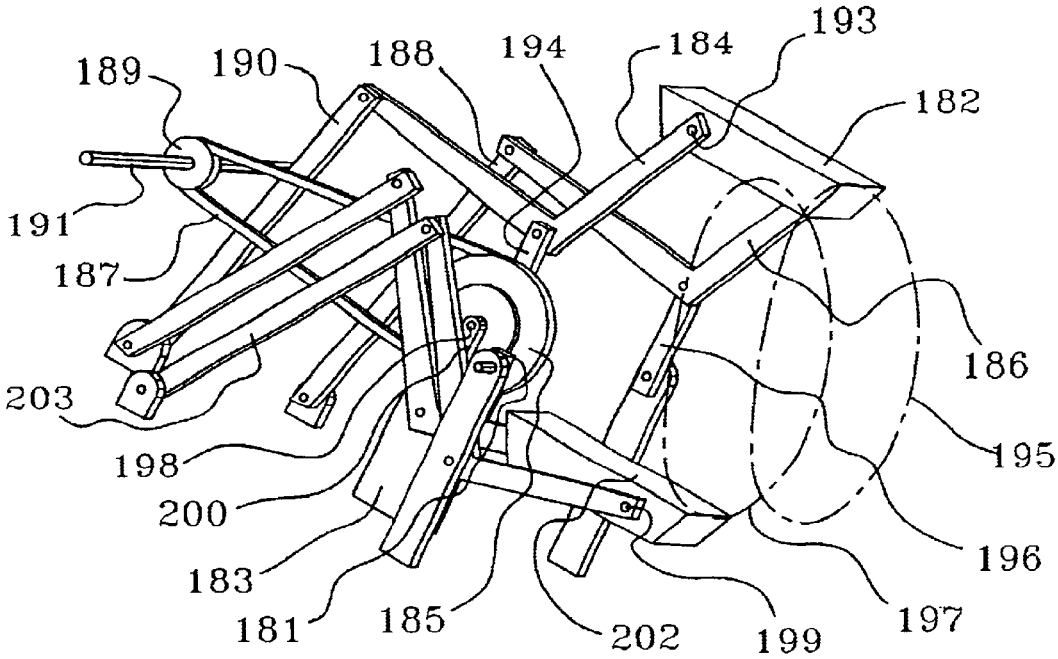
FIG. 7 is a perspective view of the dual linkage system shown in FIG. 6.

Referring now to FIG. 7, a perspective view is shown of the dual linkage mechanism shown in FIG. 6 corresponding to the first embodiment. First connector link 184 and third connector link 186 are rotatably secured at first foot platform 182 left and right sides, or first first foot platform joint 193 and third first foot platform joint respectively. The first connector link 184 is rotatably secured to first crank radius 194. First crank radius 194 is rigidly connected to second crank radius 200 at crank axle 198. Both cranks have a crank radius established diametrically opposite. Crank axle is supported at each side of crank pulley 185 by crank support plate 183. If desired, the crank pulley could be secured to rotate with any of the four cranks: first crank radius 194, second crank radius 200, third crank radius 196, or fourth crank radius 181. Continuing with the illustrated pulley 185, the crank support plates 183 are stationary with the machine frame. Flywheel pulley 189 is attached to flywheel shaft 191 and is driven via flywheel belt 187. Second foot platform 202 second motion path 197 lies in a plane parallel to the first motion path 195 of first foot platform 182. The first foot platform 182 is shown approximately at its uppermost position, and second foot platform 202 is shown approximately at its lowermost position. First crank radius 194 is of the same crank length as all other crank lengths. The dual linkage mechanism is secured to the stationary machine frame at a total of eight separate points, and four distinct rotational axis. First rocker link 190 and third rocker link 188 are orientated identically, and are rotatably secured to stationary base points symmetrical with their left side counterparts. Fourth rocker link 203 is rotatably connected to fourth connector link, and fourth connector link is rotatably connected to second second foot platform joint 199. Second first foot platform joint is directed into the paper, and is not visible in this figure.

Figure 8:
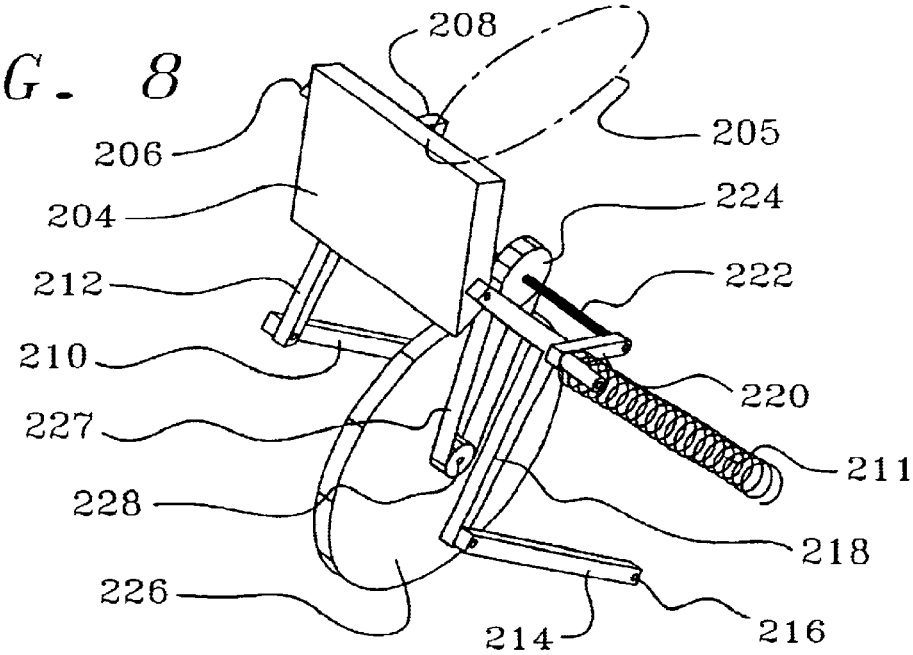
FIG. 8 is a perspective view of the four bar mechanism of the first embodiment and shows two four bar mechanisms connected to one relatively wide platform for use with both feet when the operator is reclined.

Directing attention now to FIG. 8, a singular first foot platform 204 is designed of proper width as to receive both feet of the user. The linkage mechanism is of a similar design of the first embodiment. The operator may power this mechanism while in a semi-reclined position, and pump the singular first foot platform 204 in a motion similar to what would be experienced when performing knee bends or standing/squatting exercises. The pad that the operator is resting upon shall preferably be inclined ten or twenty degrees. Third crank radius 208 is rotatably secured to both the unillustrated machine frame and to third connector link 206. Third connector link distal end 212 is rotatably secured to third rocker link 210. First rocker link 214 is rotatably secured to the machine frame at pin joint 216, and also to first connecter link 218. The foot platform will translate about a first path 205 while maintaining constant angular orientation with respect to the machine frame. Crank shaft 222 is rotatable secured to the machine frame and supports both the first crank radius 220 and a flywheel drive pulley 224. The flywheel 226 is driven by flywheel drive pulley 228 via flywheel endless drive member 227. The flywheel endless member may be a standard V-belt, a timing belt or synchronous belt, a flat or round belt, or a roller chain. A flywheel is particularly desirable in this version of the first embodiment because the momentum of the flywheel 226 may be necessary to power the foot platform during return motion toward the operator. Shown also in this figure is a compression spring 211 to always return and park the first foot platform 204 toward the operator past both cranks top dead center position when the exercise machine is idle. This will bias the mechanism to a starting position and enable the foot platform to readily move in the correct direction upon machine startup during applied foot compression force against first foot platform 204. This compression spring 211 need have only a relatively low spring constant to serve this function, although if distinct and adjustable force characteristics are desired to be incorporated, the spring constant could be increased appreciably such that a flywheel need not be present. In this regard, a spring of significant constant may be present; particularly on embodiments which do not have the foot platforms coupled together at a common crank axis (platforms may be cycled independently) in order to supplement or replace the flywheel. The spring may be secured at one end to the machine frame, and at the opposite end to any suitable anchor point upon the mechanism including one or more of the cranks, rockers, connector links, or even upon the foot platforms. For example, if a spring is incorporated into the linkage on FIG. 7 to assure return of the foot platforms, then the cranks 194 and 200 would not need to be physically connected.

It may be noted that reference is made of 'first' and 'third' members in FIG. 7 in order to be consistent with the text. In this respect, text reference to 'first' and 'third' always corresponds to the first foot platform, and text reference to 'second' and 'fourth' always corresponds to the second foot platform, if the referenced members exist in the figure. Also, although this figure shows 'third' members, it would still function well if only 'first' members were present, properly resulting in a foot platform mounted rotatably to the connector link. This foot platform would then function much like one oversized bicycle pedal.

Figure 9:
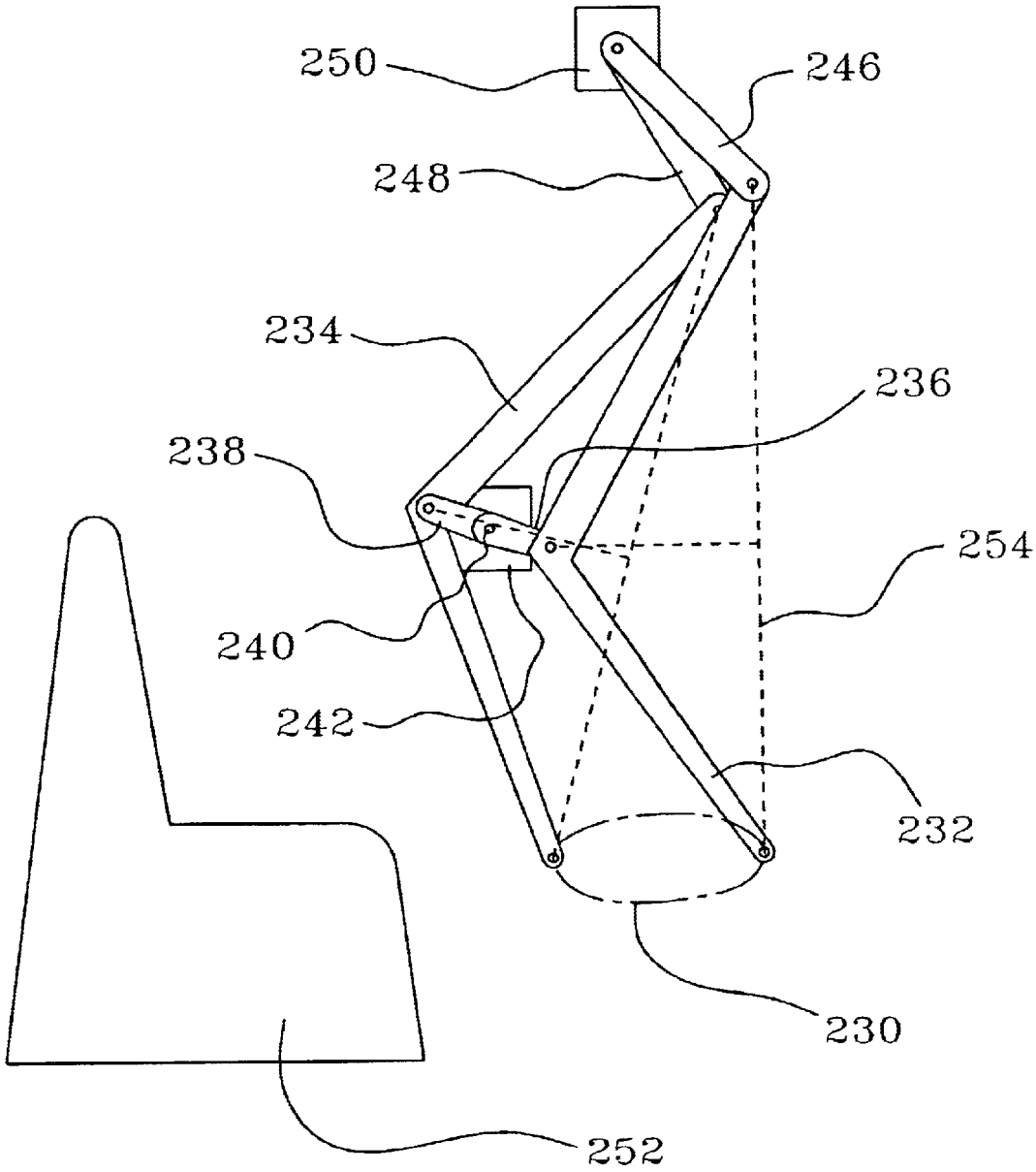
FIG. 9 is a side view of an exercise machine which incorporates a four bar mechanism similar to FIG. 3*a*.

Referring now to FIG. 9, datum lines 254 indicate a linkage arrangement corresponding to FIG. 3*a* of the first embodiment. First rocker joint 246 and second rocker joint 248 are rotatably secured to machine frame 250 at a common axis. First connector link 232 and second connector link 234 are rotatably secured to first crank radius 236 and second crank radius 238. First and second cranks 236 and 238 have collinear rotational axes 240 about a point stationary with the machine frame 242. The reader will note that on all of the embodiments illustrated, the paired first and second and/or third and fourth cranks revolve, and are represented as rigid members sharing a one axis of rotation. These revolving cranks may therefore be replaced by a disk, wheel, or even a flywheel with pin joints established at diametrically opposite positions if dimensional mounting constraints allow. The elliptical path 230 of the unillustrated foot platforms is situated to be readily engageable with the operators feet when the operator is positioned in seat 252.

Figure 10:
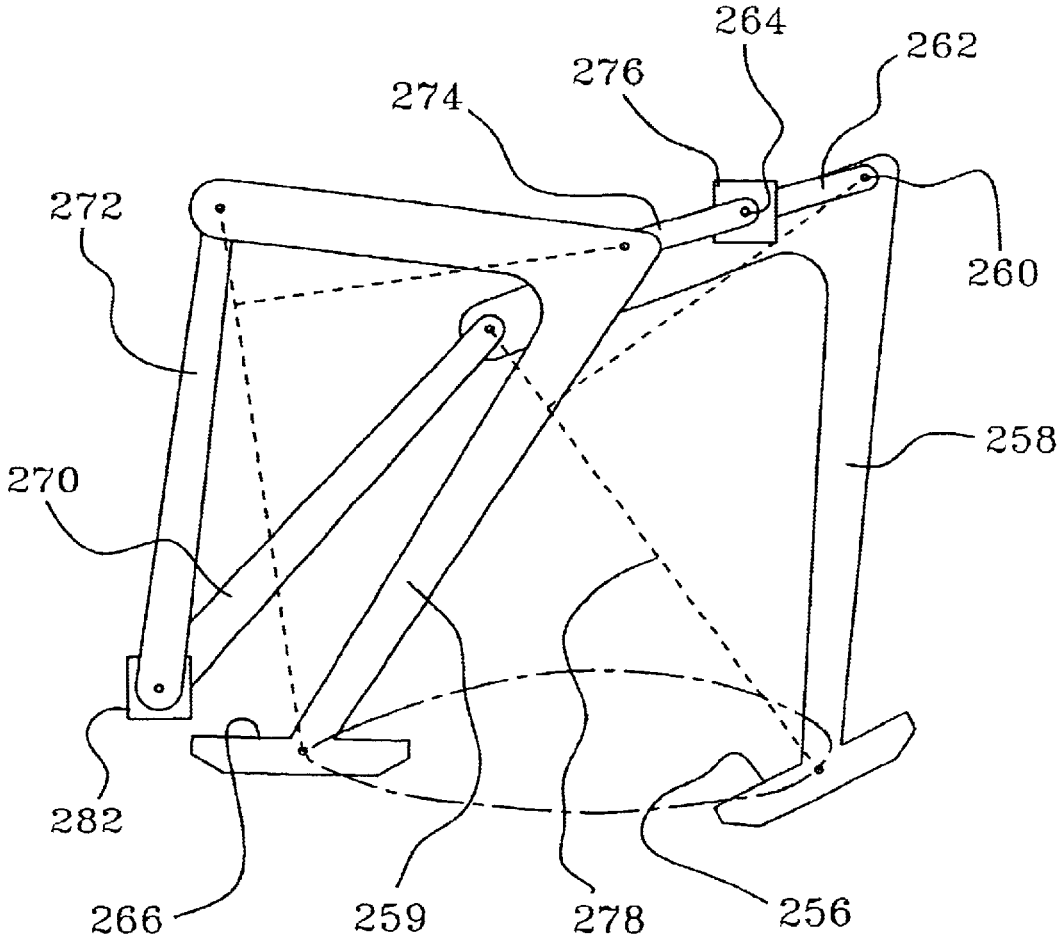
FIG. 10 is a side view of an exercise machine which incorporates a four bar mechanism similar to FIG. 3*b*.

Directing attention now to FIG. 10, a closed curve is shown which will produce a motion at the foot platforms which represents an ellipse of relatively sharp proportions. The datum lines 278 are characteristic of the mechanism shown in FIG. 3*b* of the second embodiment. The linkage mechanism may be operated while one is standing. First and second foot platforms 256 and 266 respectively may be rigid with first and second connector links 258 and 259 respectively. First cranks radius 262 and second crank radius 274 are rotatably secured at rotational joint 264 attached to machine frame 276. Corresponding to the first connector link, pin joint 260 allows full rotation of first connector link 258 relative to first crank radius 262. First rocker link 270 and second rocker link 272 are rotatably attached to first and second connector links 258 and 259 respectively, and are also rotatably secured to machine frame 282 while sharing a common rotational axis.

Figure 11:
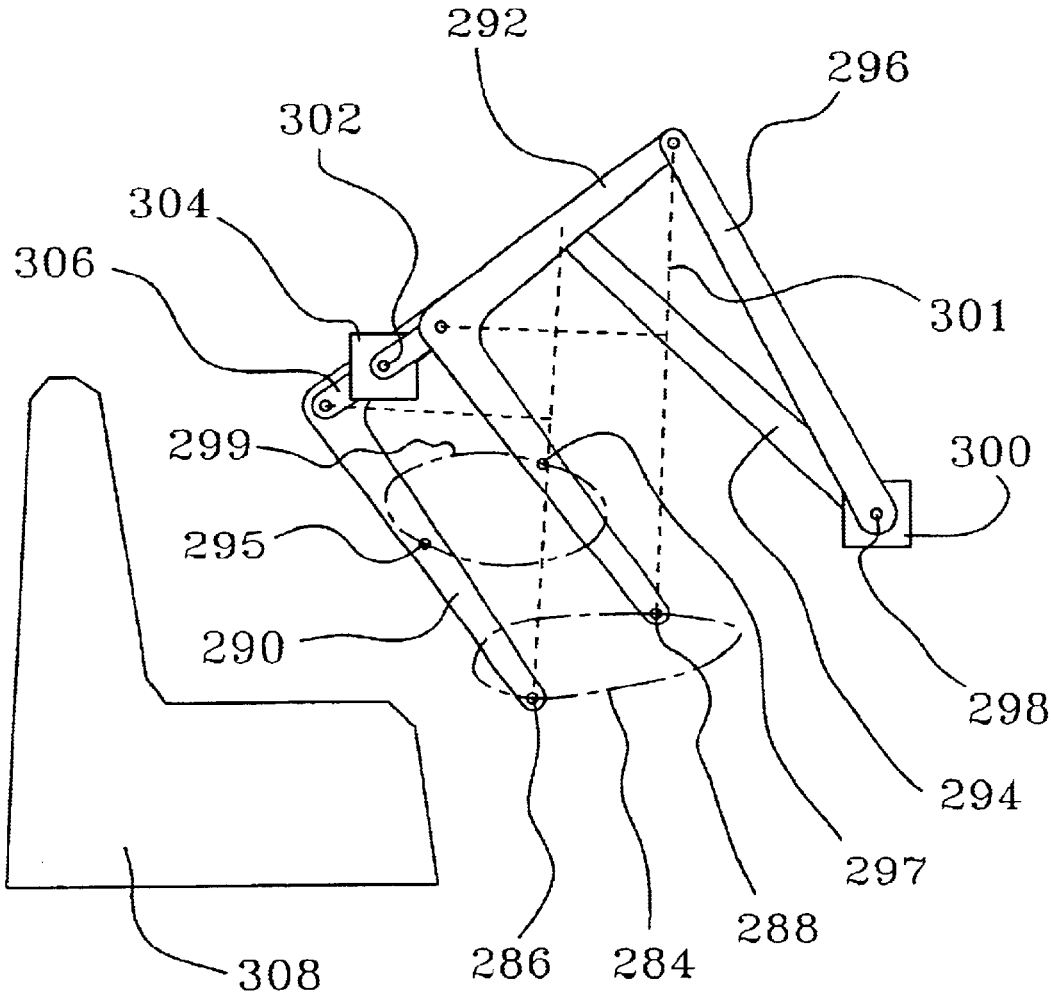
FIG. 11 is a side view of an exercise machine which incorporates a four bar mechanism similar to FIG. 3*b*, and has a crank positioned for supplemental upper body exercise while the operator is seated.

Referring now to FIG. 11, a linkage mechanism is shown with datum lines 301 indicating an arrangement similar to FIG. 3*b*. Foot platforms are rotatably secured to first and second connector links 292 and 290 at bearings 288 and 286 respectively. First and second rocker joints 296 and 294 share a common rocker rotational axis 298 at a portion of the machine frame 300. Crank 306 has pin joints symmetrically opposite each side of crank rotation axis 302. Crank rotational axis does not translate with respect to machine frame 304. In this embodiment the operator will be positioned in seat 308 and crank the unillustrated foot pedals along the illustrated elliptical path 284.

Note that in this embodiment, first and second connector links 292 and 290 may have attached handle bars 297 and 295 respectively which may be moved throughout a closed handle bar curve 299 generated at the handle bar attachment point. In this configuration, the user cyclically forces the foot platforms throughout their elliptical path while simultaneously exercises the upper body by forcing the handle bar throughout its elliptical path 299 during the use of ones' arms and hands. By attaching the handles closer to the rocker joints than the attachment point of the foot platforms are to the rocker joints, the closed curve path 299 generated at the handle bar is relatively smaller than the closed curve path 284 generated at the foot platforms. An upper and lower body exercise machine such as this would be operated by alternatingly pushing with ones feet and pulling with ones arms. In describing this motion, as the operator faces the machine and the two somewhat horizontal elliptical paths, the operator will pull with his/her right arm at the lower region of the handle bar path 299 while freely returning his right foot at the lower portion of the right foot pedal path 284, followed by returning his/her right hand forward at the upper half of the handle bar path 299 and pushing his/her right foot at the upper half of the foot pedal path 284. The left side of the operators body would be out of phase with the right side by 180 degrees.

If both feet are placed upon one platform, and only one crank, rocker, and connector link exists on the machine, the exercise machine has operational characteristics unique to the exercise industry. An upper and lower body exercise machine such as this would be operated by alternatingly pushing both feet and pulling with both arms. In describing this motion, as the operator faces the machine and the two horizontal elliptical paths, the operator will pull with both arms at the lower region of the top ellipse while freely returning both feet at the lower portion of the bottom ellipse. This action will be followed by returning both hands forward at the upper half of the top ellipse while pushing both feet at the upper half of the bottom ellipse. This action is not to be confused with a rowing machine action for the following three reasons: (1) the upper body and the lower body is exercised at a phase difference of 180 degrees, as opposed to the rowing machine which stresses both the upper and lower body simultaneously; (2) most rowing machines do not include a flywheel; and (3) continuous cyclical motion exists with the present invention as opposed to the stop and go or continuously reversing action of a rowing machine.

Figure 12:
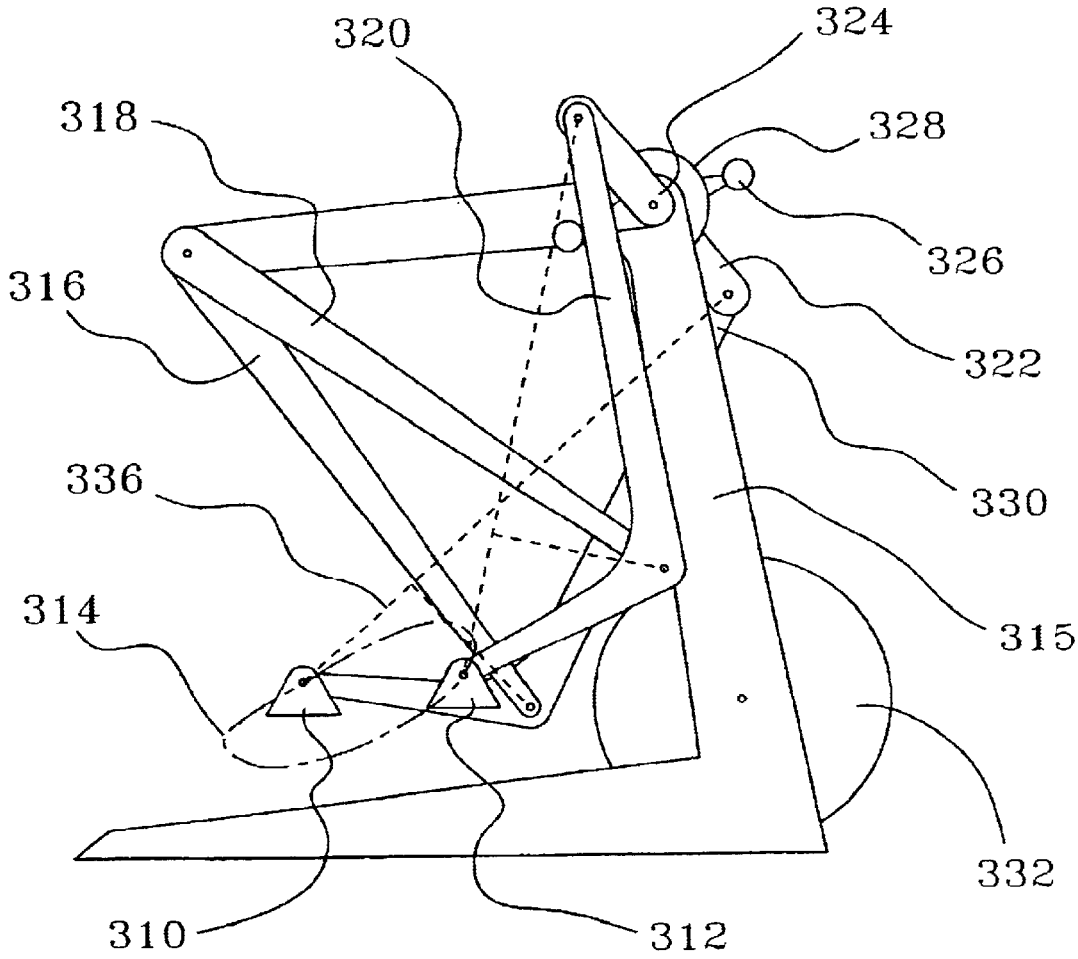
FIG. 12 is a side view of an exercise machine which incorporates a four bar mechanism similar to FIG. 3*c*.

Continuing now with FIG. 12, a third embodiment is shown with datum lines 336 similar to both FIG. 3*c* and FIG. 3*d*. In these figures, if a segment line is established between the connector link crank journal (first first connector link joint) to the connector link foot platform journal (first third connector link joint), and then a perpendicular line is drawn passing through the connector link rocker journal (first second connector link joint), the perpendicular line will intersect the segment line between the segment line endpoints.

As further shown on FIG. 12, the proximity of the crankshaft 324 enables the operator to stand while optionally rotating the handle grips 326 of crank 322 by hand. Crank 322 is rigid between the rotational axis of the upper distal ends of first connector link 320 and second connector link 330, and rotatably secures the upper distal ends of the connector links as they revolve about the crank rotational axis. First and second rocker links 318 and 316 share a common rotational axis fixed to the machine frame 315 thereby allowing the required pivoting or oscillating motion. First and second foot platform 312 and 310 respectively travel along the now familiar elliptical path 314 during crank rotation. Crank pulley 328 may be of sufficient size and mass as to adequately serve as a flywheel, or may drive a flywheel 332 rotatably secured to the machine frame 315.

Figure 13:
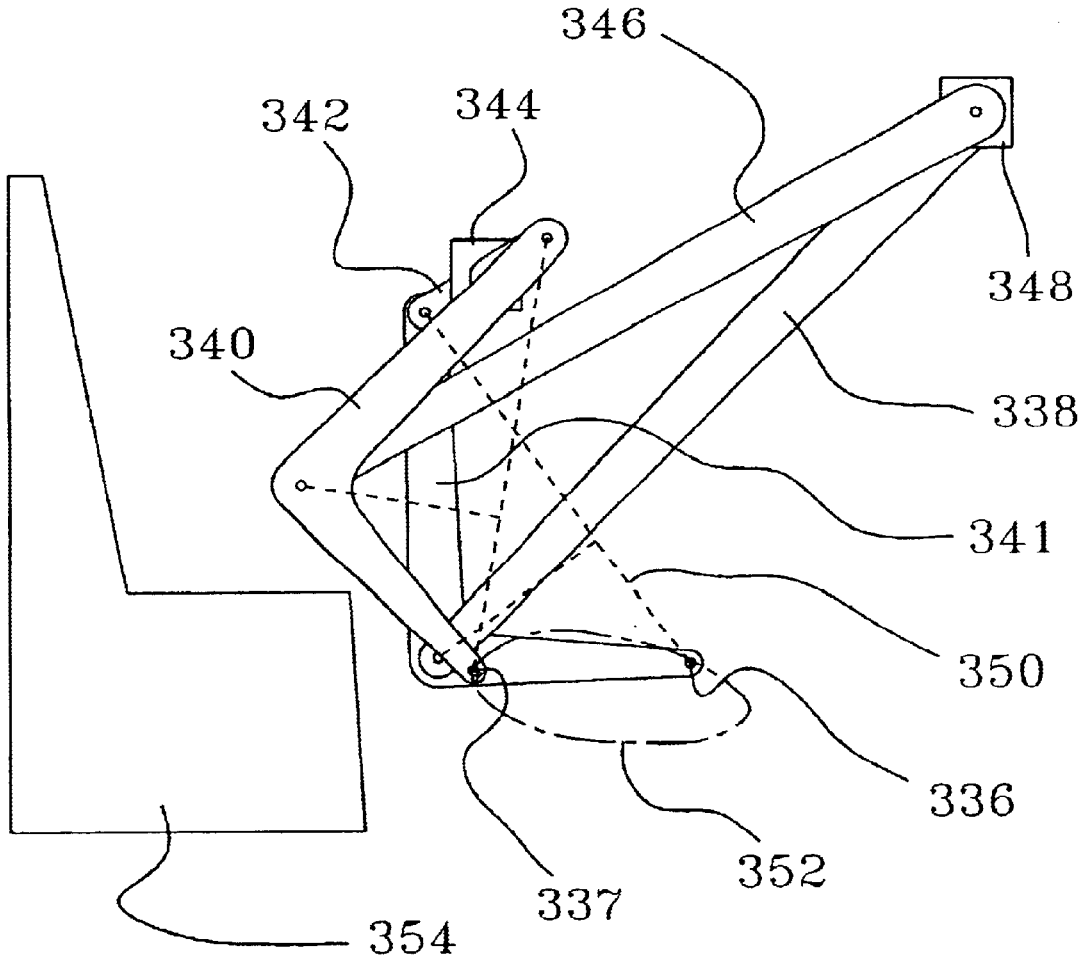
FIG. 13 is a side view of another exercise machine which incorporates a four bar mechanism similar to FIG. 3*c* and has a crank positioned in close proximity to a seated operator to provide supplemental and optional upper body exercise.

Directing attention now to FIG. 13, datum lines 350 depict a linkage system similar to FIG. 3*c*. This is another arrangement of linkages which allows the operator to be seated while exercising both the upper and lower body, without the necessity of additional mechanical elements such as pulleys or actuators to bring working curves within proximity of both the upper and lower body. Crank 342 rotates about a point fixed to machine frame 344, and connects at opposite crank radii to first and second connector links 341 and 340. First and second rockers 338 and 346 pivot about a point fixed to the machine frame 348, and are physically placed at each side of the operator as to not interfere with the operators leg motion. Elliptical path 352 is generated at pin joints 336 and 337.

When the operator is positioned in seat 354, both the foot pedals and the hand grips may be adjusted to fit the operator properly. This may be accomplished by changing the distance between the machine frame and the seat 354, and/or changing the orientation and/or shape of the elliptical path (s). To change the orientation or angle between the major axis of the elliptical path relative to a horizontal plane, simply rotate the machine frame including portions 344 and 348 about which the cranks and rockers are rotatably secured. To change the shape of the elliptical path, two of the simplest methods is to change the distance between the two machine frame regions 344 and 348 resulting in a new centerline distance between the machine frame secured rotational axes of the cranks and rockers, or alternatively adjust and change the length of any or all of the three dynamic links (cranks, connector links, and rockers).

Figure 14:
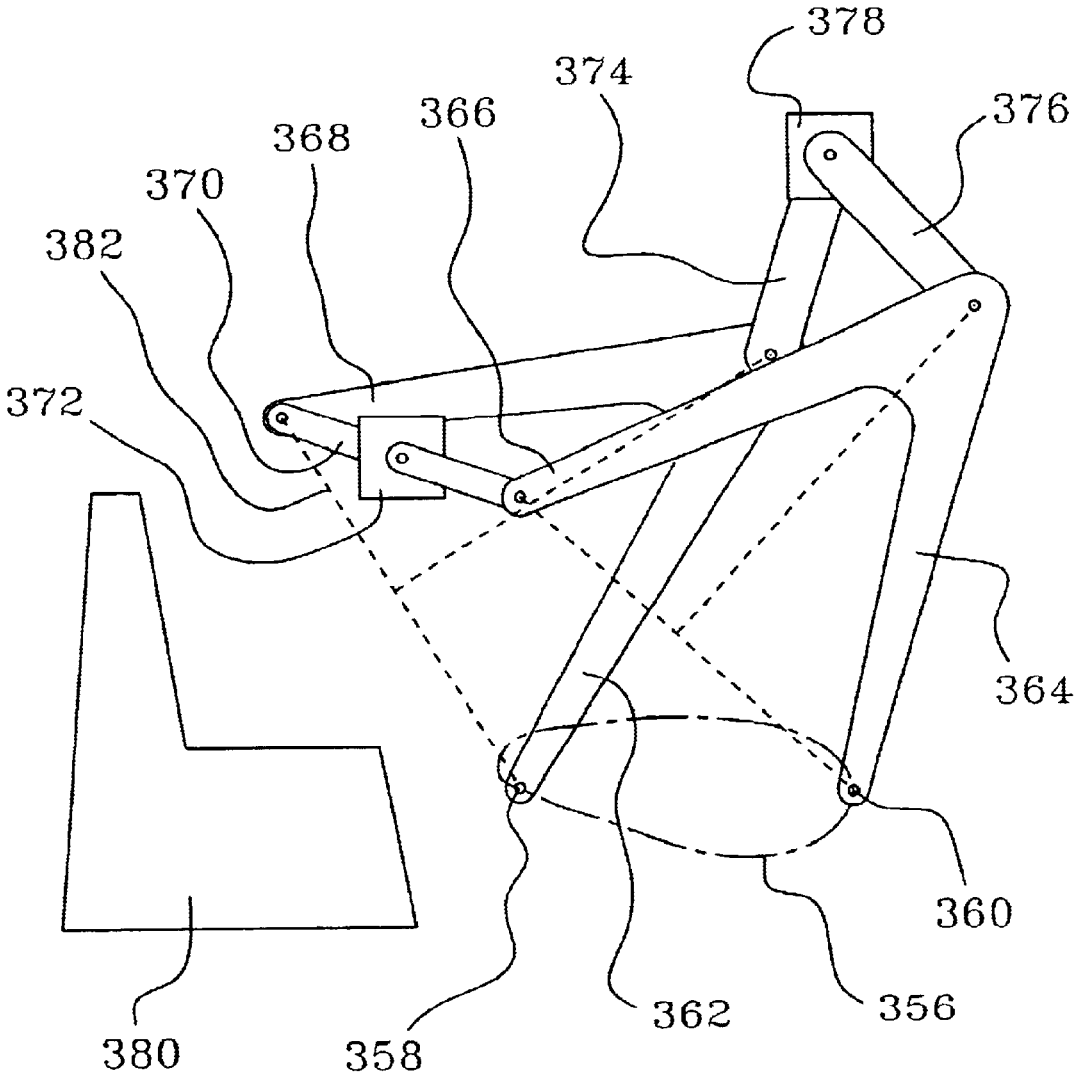
FIG. 14 is a side view of an exercise machine which incorporates a four bar mechanism similar to FIG. 3*b*, and also allows for supplemental upper body exercise motion.

Referring finally now to FIG. 14, datum lines 382 most closely represent the linkage mechanism of FIG. 3*a*. Crank 370 revolves about a point fixed to the machine frame 372, and rotatably secures first and second proximate connector link regions 366 and 368. First and second rocker links 376 and 374 pivot about a point fixed relative to a portion of machine frame 378. First and second connector links 364 and 362 are rotatably secured to the crank 370 and to first and second rocker 376 and 374. The operators feet may exert force directly on perpendicular shafts 360 and 358, or upon unillustrated rotatable foot pedals rotatably joined at shafts 360 and 358. The operator seat 380 may be positions for optimum comfort while cycling his/her feet along the elliptical path 356. Again, as with all embodiments, the elliptical path may also be customized to preferences of the operator.

Thus, an improved exercise machine is shown which provides the operator with motions or combinations of motions which are new in the art. While preferred embodiments of the invention have been shown and described, it will be apparent to those skilled in the art that changes and modifications can be made in these embodiments without departing from the principles and spirit of the invention, the scope of which is defined in the appended claims.

What is claimed is:

1. An elliptical exercise apparatus, comprising:

a frame designed to rest upon a floor surface;

a left crank and a right crank, wherein each said crank is rotatably mounted on the frame;

a left rocker link and a right rocker link, wherein each said rocker link is pivotally mounted on the frame;

a left foot platform and a right foot platform; and a left connector link and a right connector link, wherein each said connector link has a first portion rotatably connected to a respective crank, a second portion rotatably connected to a respective rocker link, and a third portion rotatably connected to a respective foot platform.

2. The elliptical exercise apparatus of claim 1, wherein each said foot platform cooperates with a respective connector link to define a respective pivot axis, and each said foot platform rocks about a respective pivot axis.

3. The elliptical exercise apparatus of claim 1, further comprising left and right limiting means for limiting pivoting of each said foot platform relative to a respective connector link.

4. The elliptical exercise apparatus of claim 1, further comprising left and right leveling means for maintaining each said foot platform level with the floor surface during exercise.

5. The elliptical exercise apparatus of claim 1, further comprising left and right stabilizing means for stabilizing each said foot platform during exercise.

6. An elliptical exercise apparatus, comprising:

a frame designed to rest upon a floor surface;

a left crank and a right crank, wherein each said crank is rotatably mounted on the frame;

a left foot platform and a right foot platform; and a left connector link and a right connector link, wherein each said connector link has a first portion rotatably connected to a respective crank, a second portion constrained to move in reciprocal fashion relative to the frame, and a third portion rotatably connected to a respective foot platform, wherein each said foot platform is connected exclusively to a respective connector link in a manner that defines a respective pivot axis, and each said foot platform rocks about a respective pivot axis.

7. An elliptical exercise apparatus, comprising:

a frame designed to rest upon a floor surface;

a left crank and a right crank, wherein each said crank is rotatably mounted on the frame;

a left connector link and a right connector link, wherein each said connector link has a first portion rotatably connected to a respective crank, a second portion constrained to move in reciprocal fashion relative to the frame, and a discrete third portion;

a left foot platform and a right foot platform; and left and right connecting means for connecting each said foot platform to a respective third portion in such a manner that each said foot platform is free to occupy any of several different orientations at each point in an exercise cycle defined by a complete revolution of each said crank.

8. The elliptical exercise apparatus of claim 7, further comprising left and right limiting means for limiting movement of each said foot platform relative to a respective connector link.

9. The elliptical exercise apparatus of claim 7, wherein each said foot platform cooperates with a respective connector link to define a respective pivot axis, and each said foot platform rocks about a respective pivot axis.

* * * * *